United States Patent [19]

Moss

[11] 4,068,568

[45] Jan. 17, 1978

[54] FIRE SAFETY SYSTEMS

[76] Inventor: Cyril Herbert Moss, Heath Common, Storrington, Sussex, England

[21] Appl. No.: 671,098

[22] Filed: Mar. 29, 1976

[30] Foreign Application Priority Data

Apr. 2, 1975 United Kingdom ..... 13423/75

[51] Int. Cl.[2] ..... F24F 13/00

[52] U.S. Cl. ..... 98/33 R; 98/1.5; 169/61

[58] Field of Search ..... 236/49; 98/1.5, 33 R, 98/43; 169/46, 60, 61, 91, 11

[56] References Cited

U.S. PATENT DOCUMENTS

| | | | |
|---|---|---|---|
| 3,570,384 | 3/1971 | McLeod | 236/49 |
| 3,758,029 | 9/1973 | Yoshida | 236/49 |
| 3,817,161 | 6/1974 | Koplon | 98/39 |
| 3,826,180 | 7/1974 | Hayashi | 98/43 A |
| 3,829,010 | 8/1974 | Jones | 236/49 |
| 3,884,133 | 5/1975 | Miller | 236/49 |
| 3,916,566 | 11/1975 | Lacombe | 98/33 R |
| 3,926,101 | 12/1975 | Moss | 98/33 R |

*Primary Examiner*—William E. Wayner
*Assistant Examiner*—R. J. Charvat
*Attorney, Agent, or Firm*—Irving M. Weiner; Pamela S. Austin

[57] ABSTRACT

This invention relates to systems for clearing smoke from buildings when a fire occurs therein. Smoke detectors are provided in communal units in the building and means are provided for maintaining the pressure in accommodation units of the building above that in the communal units under normal conditions, so that there is a flow of air from the accommodation units to the communal units through the cracks in the doorways separating the accommodation units from the communal units. This flow of air ensures that, if a fire occurs in any one of the accommodation units, smoke will be carried into one of the communal units where it will be detected by one of the smoke detectors. When smoke is detected, conditions are reversed, so that the pressure in the communal units is maintained above that in the accommodation units. As a result, there will be a flow of air from the communal units to the accommodation units, once again through the cracks in the doorways. This flow of air will prevent further smoke from entering the communal units from the accommodation unit in which the fire has occurred, and will ensure that the communal units remain free of smoke to provide a means of escape for the occupants of the accommodation units.

14 Claims, 5 Drawing Figures

Fig. 1.
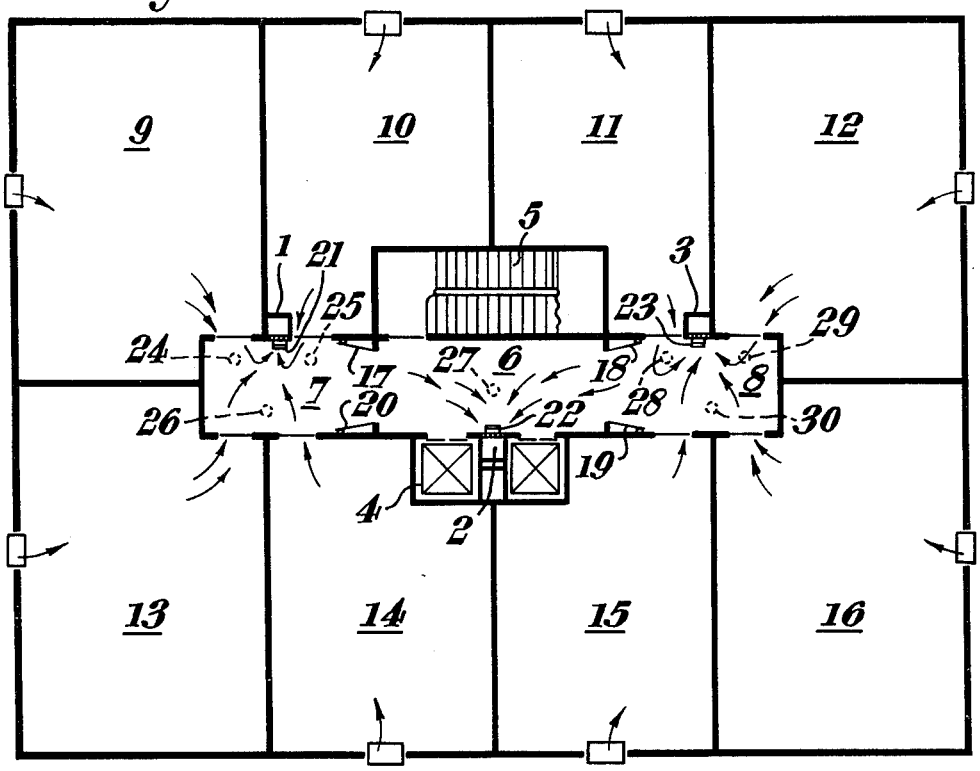
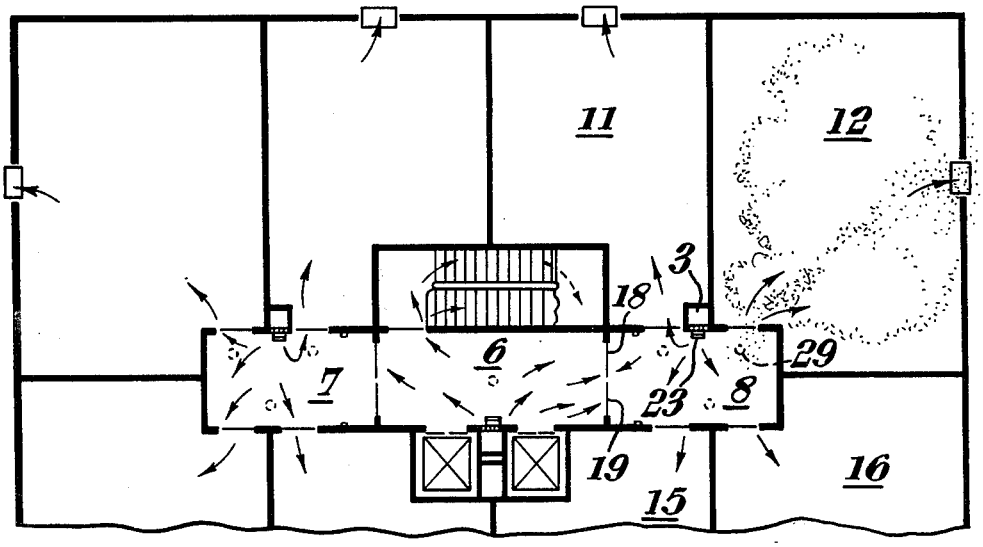
Fig. 2.

FIRE SAFETY SYSTEMS

This invention relates to fire safety systems and it is an object of the invention to provide an improvement in, or modification of, a fire safety system as claimed in United Kingdom Pat. Specifications Nos. 1,397,611 and 1,397,612 or in my U.S. Pat. No. 3,926,101.

All said patent specifications and patent are concerned with fire safety systems for use in buildings having a plurality of accommodation units and at least one communal unit providing means of access to said accommodation units, and with means for maintaining a smoke-free path through the communal unit if a fire occurs in one of the accommodation units.

In particular, in U.S. Pat. No. 3,926,101 there is claimed a fire safety system for use in a building having a plurality of accommodation units and a plurality of communal units providing means of access to said accommodation units, said system including a plurality of smoke detectors in said communal units and means controlled by said smoke detectors and responsive to detection of smoke in one of said communal units to admit air under pressure to that communal unit and to restrict passage of smoke from that communal unit to another communal unit or other communal units.

In the system described in the said U.S. Patent, the communal units are ventilated under normal conditions by supplying air to the communal units from one vertical shaft, and extracting the air through two other vertical shafts. This arrangement ensures that there is a continual change of the air in the communal units and causes parts of the communal units to be above atmospheric pressure, while other parts are below atmospheric pressure. However, the overall value of the pressure in the communal units is substantially equal to atmospheric pressure. Assuming that the pressure in each of the accommodation units is also substantially equal to atmospheric pressure, there will normally be no passage of air from the communal units to the accommodation units or vice versa. Nevertheless, the system described relies for the detection of a fire on the escape of smoke into one of the communal units from the particular accommodation unit in which the fire has occurred. This escape of smoke will be caused by the increase of pressure in the particular accommodation unit due to the heat generated by the fire. However, in some cases, particularly if there is a window open in the particular accommodation unit, or if the windows are badly fitting, it may take some time for the pressure in that accommodation unit to increase sufficiently for smoke to penetrate through the door into the communal unit. Thus, there may be some delay before the system responds to the occurrence of the fire.

Accordingly, it is an object of the present invention to provide a fire safety system of the general kind referred to in the said U.S. Patent, in which such delays in operation of the system are less likely to occur.

It is to be understood that it would be possible to eliminate these delays by providing smoke detectors in all the accommodation units, possibly as well as in the communal units. However, in some buildings it may be undesirable to provide smoke detectors in all the accommodation units, particularly since in such buildings it may be difficult to prevent smoke detectors from being damaged if they are located in the accommodation units, and furthermore, since it may be difficult to obtain access to the accommodation units in order to repair or maintain the smoke detectors.

Accordingly, it is a further object of the invention to prevent delays in the detection of fires without the necessity for providing smoke detectors in all the accommodation units.

The invention consists in a fire safety system for use in a building having a plurality of accommodation units and at least one communal unit providing means of access to said accommodation units, said system including at least one smoke detector in said communal unit and means for maintaining the pressure in said accommodation units above that in the communal unit when no smoke is detected by said smoke detector and for maintaining the pressure in said communal unit above that in the accommodation units when smoke is detected by said smoke detector.

Preferably, the pessure in the accommodation units is maintained above that in the communal unit under normal conditions by reducing the pressure in the communal unit below atmospheric pressure. If desired, the effect may be increased by also increasing the pressure in the accommodation units above atmospheric pressure. Similarly, the pressure in the communal unit is preferably maintained above that in the accommodation units when smoke is detected by maintaining the pressure in the communal unit above atmospheric pressure. It is to be understood that the pressure differential across the doorways separating the accommodation units from the communal unit will result in a flow of air through the cracks around the door frames. Under normal conditions the direction of this flow will be from the accommodation units to the communal unit, whereas, when smoke is detected, the direction of flow will be reversed.

The flow of air from the accommodation units to the communal unit will ensure that, if a fire occurs in any of the accommodation units, smoke will travel through the cracks around the door frame and will enter the communal unit. As a result, provided the smoke detector or detectors is, or are, properly located, this smoke will be detected and the pressure conditions will be reversed. As a result, there will be a flow of air from the communal unit to the accommodation units and this flow will prevent smoke entering the communal unit from the accommodation unit in which the fire has occurred. Consequently, the communal unit will be kept free of smoke and will provide a means of escape for the occupants of all the accommodation units.

The pressure in the communal unit may be reduced below atmospheric pressure under normal conditions by drawing air from the communal unit into a vertical air shaft by means of a fan associated with a vent in the air shaft. Alternatively, if the communal unit has one or more external walls, the pressure may be reduced by means of a fan located in the, or each, external wall. If the communal unit does not have any external wall, i.e., a wall in contact with the exterior of the building, horizontal ducts may be provided between the communal unit and one or more external walls of the building, and fans may be associated with these ducts to draw air from the communal unit into the ducts and thence to the exterior of the building.

To ensure that the pressure in the communal unit is below the pressure in the accommodation unit under normal conditions, it is necessary to provide means for allowing the pressure in the accommodation units to remain at or above atmospheric pressure. Means for maintaining the accommodation units at atmospheric pressure may be, for example, in the form of permanently open ventilators in exterior walls of the building. Alternatively, if the pressure in the accommodation units is to be maintained above atmospheric pressure under normal conditions, this pressure increase may be obtained by means of air conditioning units which draw air from the exterior of the building into each of the accommodation units.

When smoke is detected, the fans in the communal unit are reversed and their speed of operation is preferably increased. Further, if the pressure in the accommodation units is normally maintained above atmospheric pressure, the fans in the accommodation units are switched off so that air can be expelled through the air conditioning units from each accommodation unit to the exterior of the building. It should be noted that it is undesirable to reverse the operation of the fans in the accommodation units, since such action might tend to draw smoke-laden air from an accommodation unit in which a fire has occurred into the other accommodation units.

The pressure differentials produced uner normal conditions should be such that air is extracted from the accommodation units through the leak areas around the doors at such a rate that three or four air changes are produced per hour. Preferably, one smoke detector should be provided on the ceiling of the communal unit immediately opposite the door to each of the accommodation units. When the fans are reversed the pressure differential between the communal unit and the accommodation units should be at least 0.2 inch water gauge.

It is to be understood that the requirement for special means to maintain the accommodation units at atmospheric pressure may not apply in older buildings in which the leak areas around the windows may be sufficient to achieve this object, even in the absence of special ventilators.

If desired, the system may be arranged so that, once smoke is detected, the pressure in the communal unit is maintained above that in the accommodation units until normal conditions are manually restored. However, it is generally preferable that the system should switch automatically from one condition to the other as smoke is cleared from the communal unit and thereafter possibly returns again to activate a smoke detector.

It is, of course, to be understood that a system in accordance with the present invention may be used in conjunction with audible or visible alarm indicators, automatically closing smoke-stop doors, or automatic opening ventilator systems.

Methods of performing the invention will now be described with reference to the accompanying diagrammatic drawings, in which:

FIGS. 1 and 2 are plan views of one floor of a multistory building provided with a first embodiment of a fire safety system in accordance with the invention respectively indicating the conditions before and after smoke has been detected; and FIGS. 3 and 4 are plan views of one floor of a multistory building provided with a second embodiment of a fire safety system in accordance with the invention respectively indicating the conditions before and after smoke has been detected.

FIG. 5 shows a circuit diagram which is applicable to the second embodiment.

DETAILED DESCRIPTION

Figure 3:
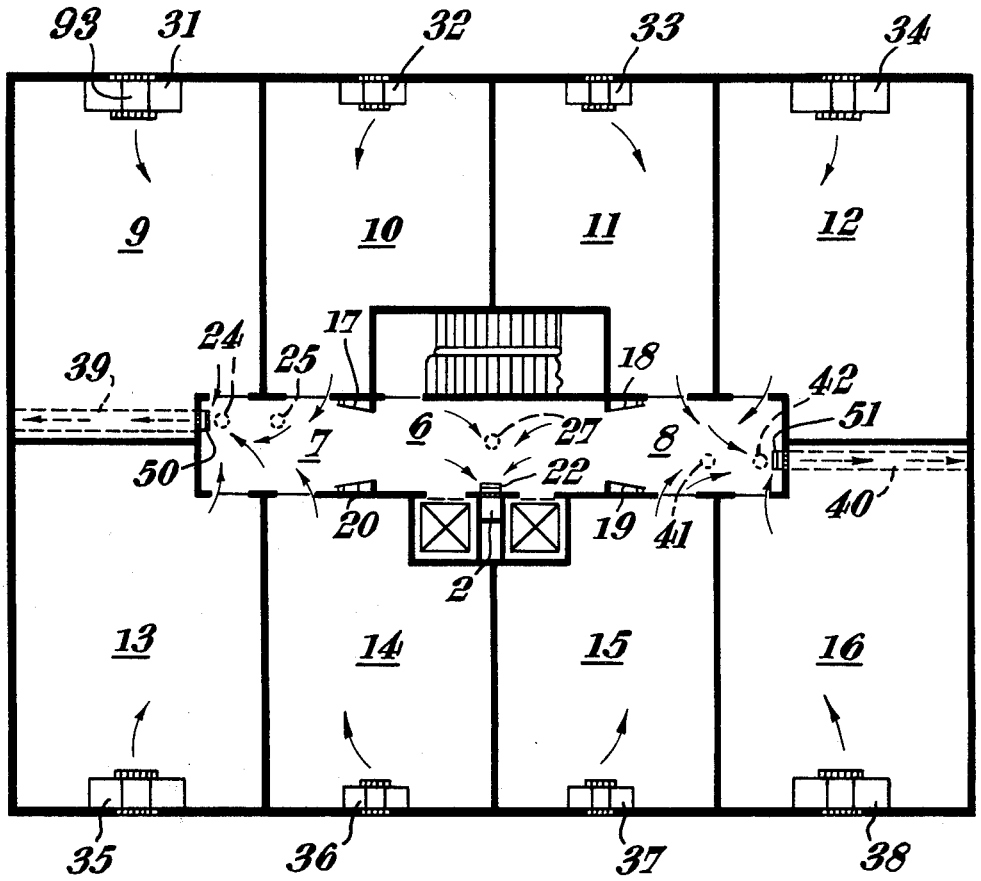

FIGS. 1 and 2 of the drawings show a fire safety system in which pressure in the accommodation units is maintained above that in the communal units under normal conditions by reducing the pressure in the communal units below atmospheric pressure. In the particular embodiment illustrated, three vertical shafts 1, 2 and 3, are provided in the building, each shaft having vents on to all floors of the building.

The building has a central lift shaft 4 and a staircase 5, with a lobby 6 located between the lift shaft and the staircase on each floor. On each floor there are also two passages 7 and 8, linking the central lobby 6 with a plurality of accommodation units 9, 10, 11, 12, 13, 14, 15 and 16. As shown, the two passages 7 and 8 are in line and extend in opposite directions from the lobby 6. Self-closing fire-stop doors 17, 18, 19 and 20 are provided between the central lobby and the two passages on each floor. The self-closing doors are normally held open as shown in FIG. 1 by electro-magnets as described in United Kingdom Pat. Specification No. 1,397,611. Thus, in this particular arrangement, there are three communal units on each floor, namely, the two passages 7 and 8 and the central lobby 6, and each of these communal units is capable of being isolated from the others by the self-closing doors. On each floor the shaft 1 is provided with a vent opening into the passage 7; the shaft 2 is provided with a vent opening into the central lobby 6; and the shaft 3 is provided with a vent opening into the passage 8. Each of the vents is provided with a fan as shown at 21, 22 and 23. Each of the fans is driven by an electric motor which is controlled by one or more smoke detectors. These detectors are shown at 24, 25, 26, 27, 28, 29 and 30. In the particular arrangement shown, all the detectors on each floor are included in a common circuit controlling all the fans on that floor and also controlling the smoke-stop doors on that floor.

The shafts 1, 2 and 3 are open to atmosphere at the top and at the bottom and, under normal conditions, each of the fans 21, 22 and 23 is arranged to draw air from the respective communal unit into the respective shaft. As is indicated by the various arrows in FIG. 1, this causes air to be drawn into the communal units through the cracks around the door frames between the various accommodation units and the communal units. The operation of the fans will reduce the pressure in the various communal units. Further, the air-flow from each accommodation unit into the respective communal unit will reduce the pressure in that accommodation unit below atmospheric pressure. As a result, there will be a further air flow from the exterior of the building into the accommodation units around the cracks in the windows in the accommodation units. If, however, the building is provided with sealed windows, so that there is little or no leakage of air into each accommodation unit from the exterior of the building, each accommodation unit should be provided with a ventilator which will allow air to enter the accommodation unit from the exterior of the building.

The continuous flow of air from each accommodation unit into one of the communal units will ensure that, if a fire occurs in any one of the accommodation units, smoke will travel through the cracks around the door frame and will enter the communal unit. The various smoke detectors are so located that the air will travel past one of these detectors in its passage through the communal unit to the respective one of the shafts 1, 2 and 3. As a result, this smoke will be detected. In particular, it can be seen that, if, for example, a fire occurs in the accommodation unit 12, smoke will be drawn from the fire past the detector 29 on its way to the fan 23 in the shaft 3.

Detection of smoke causes all the fans 21, 22 and 23 to be reversed so that conditions become as shown in FIG. 2 rather than as shown in FIG. 1. Detection of smoke also releases the magnets holding the fire-stop doors open, so that the lobby 6 is isolated from the passage 7 and 8. Further, it is preferred that detection of smoke not only reverses the direction of the operation of the fans, but also increases their speed.

As a result of the closure of the fire-stop doors 18 and 19 and the reversal of the direction of operation of fan 23, the pressure in the lobby 8 is increased above the pressure in the accommodation unit 12. As a result, there will be a flow of air as indicated by the arrows from the passage 8, through the cracks around the door-frame into the accommodation unit 12 and out to the exterior of the building through the cracks around the window or special ventilator provided in the accommodation unit 12. This air-flow will prevent smoke entering the passage 8 from the accommodation unit 12. Consequently, the passage 8 will be kept free from smoke and will provide a means of escape for the occupants of the accommodation units 11, 12, 15 and 16.

As already mentioned, in the particular embodiment being described, the fans will also be reversed in the lobby 6 and the passage 7. This arrangement will ensure that these communal units also remain free from smoke to provide a safe means of escape.

The size and speed of operation of the fans 21, 22 and 23 will depend on the size of the building and the number of vertical shafts provided. However, in one particular embodiment, each of the fans operates normally to draw 150 cubic feet of air per minute into the respective shaft and, when smoke is detected, operates to expel air from the respective shaft at the rate of 600 cubic feet per minute.

Figure 4:
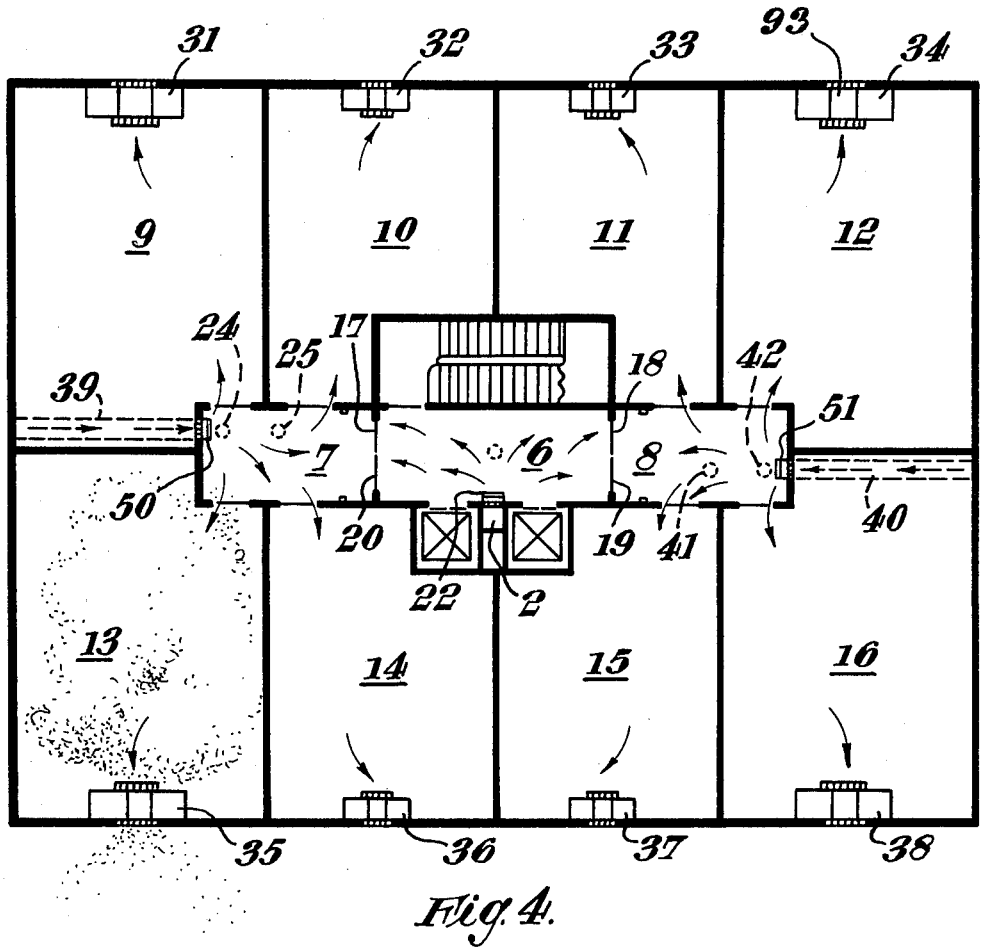

FIGS. 3 and 4 of the drawings illustrate an embodiment of the invention in which the pressure in the accommodation units is maintained above that in the communal units under normal conditions, by increasing the pressure in the accommodation units above atmospheric pressure and by reducing the pressure in the communal units below atmospheric pressure. The particular embodiment illustrated is similar to that shown in FIGS. 1 and 2 in that there are eight accommodation units 9 to 16 on each floor arranged around a central lobby 6 and passages 7 and 8 providing means of access from the accommodation units to a lift shaft 4 and a staircase 5. There is also a vertical shaft 2 having a vent and a fan 22 on each floor, but the vertical shafts 1 and 3 are replaced by horizontal ducts 39 and 40 provided respectively with fans 50 and 51.

The accommodation units 9 to 16 are provided respectively with air conditioning units 31 to 38 which can be used either for heating or cooling air introduced into their respective accommodation units. These air conditioning units normally operate to draw air from the exterior of the building through the openings shown in the outside walls thereof. The air is heated or cooled as required to maintain a predetermined temperature and is forced, under pressure, into the respective accommodation unit. The air normally escapes from each accommodation unit into the passage 7 or 8 through the cracks around the respective door frames, and leaves the respective passage either through the lobby 6 and the vertical shaft 2, or through the horizontal ducts 39 and 40 extending from the respective passage to the exterior of the building, it being understood that the fan 22 operates to draw air from the lobby 6 into the shaft 2, the fan 50 operates to draw air from the passage 7 into the duct 39, and the fan 51 operates to draw air from the passage 8 into the duct 40.

Smoke detectors 24 and 25 are provided in the passage 7; smoke detectors 41 and 42 are provided in the passage 8; and a smoke detector 27 is provided in the lobby 6. Each of these smoke detectors is connected to the fans 22, 50 and 51, to the magnets holding open the self-closing doors 17 to 20, and to the air conditioning units in all of the accommodation units of the respective floor, in such a way that, if smoke is detected by any smoke detector, it releases the magnets holding the self-closing doors, switches off the fans and the heating or cooling systems in all the air conditioning units, and causes the fans 22, 50 and 51 to reverse their direction of operation so that they serve to draw air from the exterior of the building and expel it into the lobby 6 and the passages 7 and 8 as shown in FIG. 4. At the same time, it preferably also serves to cause the fans 22, 50 and 51 to operate at an increased speed.

Under normal conditions, a fan 93 in each of the air conditioning units 31 to 38 operates to draw air into the respective accommodation unit from the exterior of the building and thus maintains the pressure in the accommodation unit above atmospheric pressure. The fan 93 in each accommodation unit may be an integral part of its associated air conditioning unit. In addition, the fans 22, 50 and 51 operate to withdraw air from the lobby 6 and the passages 7 and 8 and expel it to the exterior of the building, thus maintaining the pressure in the communal units 6, 7 and 8 below atmospheric pressure. Consequently, air flows through the cracks of the door frames from each of the accommodation units into the communal units. Thus, if a fire occurs in one of the accommodation units, for example in the accommodation unit 13, as shown in FIG. 4, smoke will pass through the door frame from the accommodation unit 13, into the passage 7, and will be drawn past the smoke detector 24 into the duct 39. As a result of this detection of smoke, the operation of each of the fans 22, 50 and 51 will be reversed and its speed will be increased. Consequently, air will flow in the direction of the arrows shown in FIG. 4. The smoke will be contained in the accommodation unit 13, and the lobby 6 and the passages 7 and 8 will be kept free of smoke. Since the fans in all the air conditioning units are switched off, the air flowing into each accommodation unit through the cracks in the door frame will pass through the respective air conditioning unit to the exterior of the building.

Figure 5:
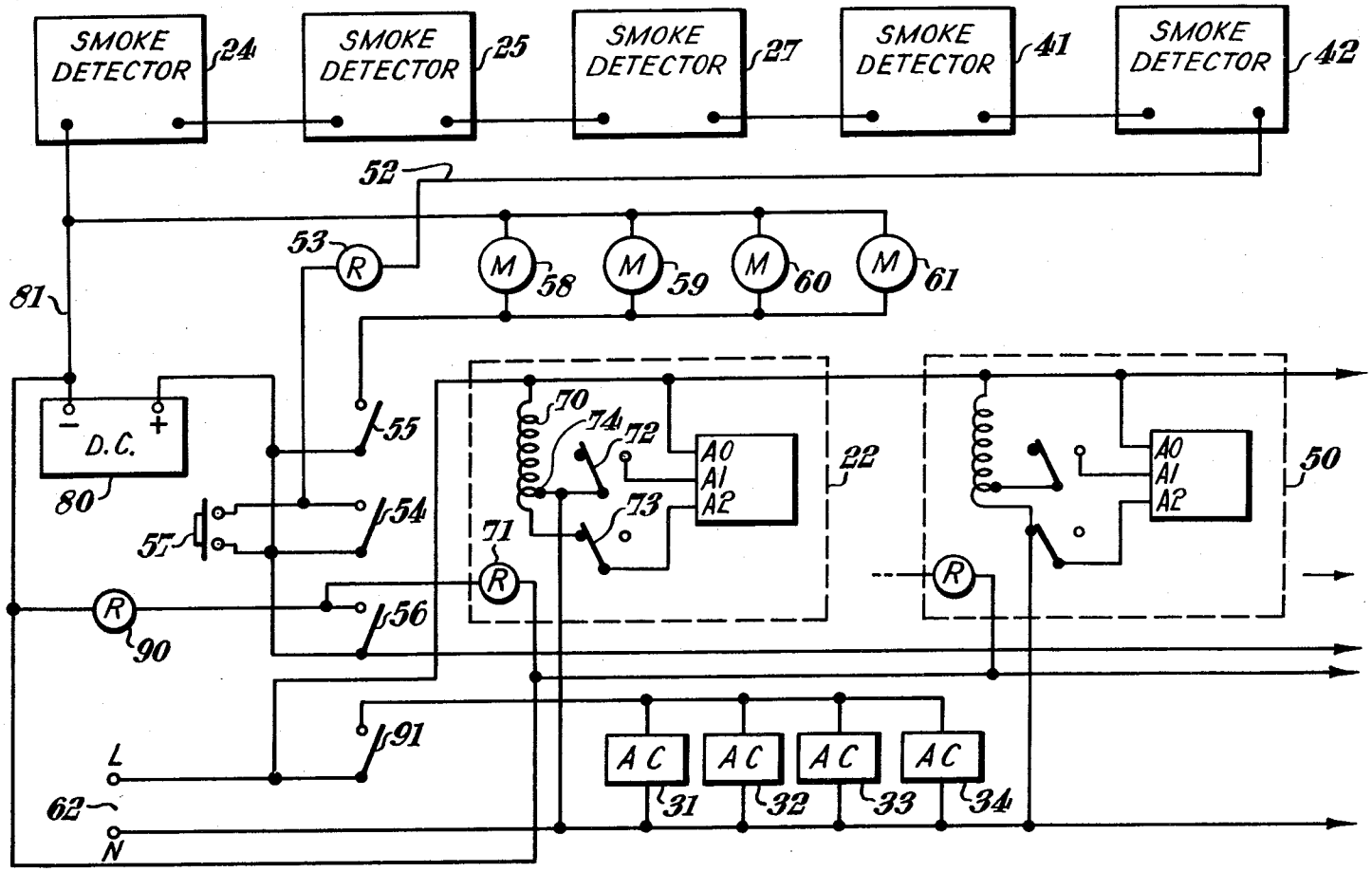

FIG. 5 is a circuit diagram showing one possible way of connecting the smoke detectors to the fans 22, 50 and 51, to the magnets holding open the self-closing doors 17 to 20, and to the air conditioning units 31 and 38. In the particular arrangement shown, all the magnets are released, all the air conditioning units are switched off, and all the fans are reversed and caused to operate at an increased speed, if smoke is detected by any of the smoke detectors 24, 25, 27, 41 or 42. Further the arrangement is such that, once smoke has been detected, these conditions are maintained until the system is manually reset.

The circuit illustrated includes a d.c. source 80, the negative terminal of which is connected by a lead 81 to one terminal of the smoke detector 24. This terminal is connected within the smoke detector to one contact of a pair of normally-closed contacts, said contacts being opened as soon as smoke is detected. The normally closed contacts in all the detectors are connected in series, and the line 52 from the last smoke detector 42 in the chain is connected to the energizing coil of a relay 53 having three pairs of normally-open contacts 54, 55 and 56. The other side of the energizing coil of the relay 53 is connected to one contact of the pair 54, the other contact of this pair being connected to the positive terminal of the d.c. source 80. A manually-operable push button 57 is connected in parallel with the contacts 54.

The magnets which hold the smoke-stop doors in the closed position are indicated by the reference numerals 58, 59, 60 and 61, and it will be seen that one side of all the magnets is connected to the negative terminal of the d.c. source, while the other side of all the magnets is connected through the contacts 55 to the positive terminal of the d.c. source.

One side of the energizing coil of a further relay 90, having a single pair of normally-open contacts 91, is connected to the negative terminal of the d.c. source, while the other side of this energizing coil is connected through the contacts 56 to the positive terminal of the d.c. source. The contacts 91 are connected between the line terminal of the main supply alternating current source 62 and one side of all of the air conditioning units 31, 32, 33 and 34.

Each of the fans 22, 50 and 51 is provided with a respective auto-transformer and control relay. In the case of the fan 22, the auto-transformer is indicated at 70 and the energizing coil of the relay at 71. This relay has two sets of change-over contacts 72 and 73. One end of the auto-transformer 70 is connected to the line terminal of the alternating current source 62 which is also connected to the A0 terminal of the fan. A tapping 74 on the auto-transformer is connected to the neutral terminal of the source 62 and also to the moving contact of the contact set 72. The normally open contact of this set is connected to the terminal A1 of the fan. The other end of the auto-transformer 70 is connected to the normally-closed terminal of the contact set 73 and the moving contact of this set is connected to the terminal A2 of the fan. The energizing coil of the relay 71 is connected in parallel with the energizing coil of the relay 90.

When the apparatus is first switched on, all the relays will be de-energized and the contacts will be in the position shown. If the push button 57 is pressed, and provided no smoke is detected by any of the detectors 24, 25, 27, 41 or 42, the relay 53 will be energized and will be maintained in this condition by the contacts 54. The magnets 58, 59, 60 and 61 will be energized by closure of the contacts 55 and, if the smoke-stop doors 17, 18, 19 and 20 are opened, they will be held open by these magnets.

Closure of the contacts 56 will energize the relay 90, and will also energize the relays 71 in the fan units 22, 50 and 51. Energizing of the relay 90 will close the contacts 91 and apply power to all of the air conditioning units. Finally, energization of the relay 71 in each of the fan units will cause the poser to be applied to the terminals A0 and A1 which will cause the fan to run at normal speed in the direction necessary to extract air from the respective communal unit.

If smoke is detected by any of the smoke detectors, the time relay 53 will be de-energized and the resultant opening of the contacts 56 will, in turn, de-energize the relay 90. Consequently, the door magnets will all be de-energized and the smoke-stop doors will close. Further, the power supply to the air conditioning units will be disconnected and the fans in these units will stop operating as well as the heating or cooling systems. Finally, in each of the fan units 22, 50 and 51, the power supply will be connected through the auto-transformer 70 to the terminals A0 and A2 which will cause the fan to operate in the reverse direction at increased speed.

What is claimed is:

1. A fire safety system for use in a building having a plurality of accommodation units and at least one communal unit providing means of access to said accommodation units, said system including at least one smoke detector in said communal unit and means for maintaining the pressure in said accommodation units above that in the communal unit when no smoke is detected by said smoke detector and for maintaining the pressure in said communal unit above that in the accommodation units when smoke is detected by said smoke detector.

2. A system as claimed in claim 1, wherein the pressure in the accommodation units is maintained above that in the communal unit under normal conditions by reducing the pressure in the communal unit below atmospheric pressure.

3. A system as claimed in claim 2, wherein the pressure in the accommodation units is maintained substantially at atmospheric pressure under normal conditions by permanently open ventilators in exterior walls of the building.

4. A system as claimed in claim 2, wherein there is provided in each accommodation unit a fan which, under normal conditions, draws air from the exterior of the building into the respective accommodation unit and thereby maintains the pressure in that accommodation unit above atmospheric pressure.

5. A system as claimed in claim 4, wherein said fan in each accommodation unit is an integral part of an air conditioning unit.

6. A system as claimed in claim 4, wherein, when smoke is detected, the fans in the accommodation units are switched off.

7. A system as claimed in claim 1, wherein the pressure in the communal unit is maintained above that in the accommodation units when smoke is detected by increasing the pressure in the communal unit, so that it is above atmospheric pressure.

8. A system as claimed in claim 1, wherein the communal unit has one or more external walls and wherein the pressure in the communal unit is reduced below the atmospheric pressure under normal conditions by means of a fan or fans located in the, or each, external wall of the communal unit.

9. A system as claimed in claim 1, wherein the communal unit does not have any wall in contact with the exterior of said building and wherein the pressure in the communal unit is reduced below atmospheric pressure under normal conditions by drawing air from the communal unit into at least one vertical shaft by means of a fan associated with a vent in the said at least one shaft.

10. A system as claimed in claim 9, wherein, when smoke is detected by the detector in the communal unit, the fan in said shaft is reversed and its speed of operation is increased.

11. A system as claimed in claim 1, wherein at least one horizontal duct is provided between the communal unit and an external wall of the building, a vent being associated with the said at least one duct to draw air from the communal unit into the duct and thence to the exterior of the building.

12. A system as claimed in claim 11, wherein, when smoke is detected the fan in said duct is reversed and its speed of operation is increased.

13. A system as claimed in claim 1, wherein the communal unit is provided with a plurality of self-closing fire-stop doors adapted to isolate one part of the communal unit from another part of the communal unit, said self-closing doors being normally held open by electromagnets and being allowed to close automatically when smoke is detected.

14. A system as claimed in claim 1, wherein a smoke detector is located in the communal unit in the vicinity of each of the doors between the accommodation units and the communal unit.

* * * * *